US005191173A

United States Patent [19]

Sizer et al.

[11] Patent Number: 5,191,173

[45] Date of Patent: Mar. 2, 1993

[54] ELECTRICAL CABLE IN REELED TUBING

[75] Inventors: Phillip S. Sizer, Dallas; Malcolm N. Council, Richardson, both of Tex.; Willard J. Deese, Sandersville, Miss.; E. G. Hoffman, Middlefield, Conn.; Robert F. Bailey, Spring, Tex.; David H. Neuroth, Hamden, Conn.

[73] Assignee: Otis Engineering Corporation, Dallas, Tex.

[21] Appl. No.: 689,465

[22] Filed: Apr. 22, 1991

[51] Int. Cl.[5] ..... H01B 7/20

[52] U.S. Cl. ..... 174/105 R; 174/47; 174/106 R; 174/102 SP; 174/113 R; 174/102 R

[58] Field of Search ..... 174/102 R, 102 SP, 106 R, 174/113 R, 116, 47

[56] References Cited

U.S. PATENT DOCUMENTS

| | | | |
|---|---|---|---|
| Re. 28,961 | 9/1976 | Tsukamoto et al. | 156/50 X |
| 1,917,129 | 7/1933 | Kirch . | |
| 2,697,772 | 12/1954 | Kinghorn . | |
| 3,394,400 | 7/1968 | Lamons | 174/102 R |
| 3,405,228 | 10/1968 | Polizzano | 174/106 R |
| 3,530,019 | 5/1968 | Polizzano | 156/54 |
| 3,555,169 | 1/1971 | Miller | 174/36 |
| 3,615,977 | 10/1971 | Lehnert et al. | 156/54 |
| 3,742,363 | 6/1973 | Carle | 174/102 R |
| 3,835,929 | 9/1974 | Suman, Jr. | 166/385 X |
| 3,889,049 | 6/1975 | Legg et al. | 174/102 R |
| 4,083,484 | 4/1978 | Polizzano et al. | 174/106 D |
| 4,137,762 | 2/1979 | Smith | 174/102 R X |
| 4,297,526 | 10/1981 | Leuchs et al. | 174/102 R |
| 4,336,415 | 6/1982 | Walling | 174/47 |
| 4,374,530 | 2/1983 | Walling | 174/47 X |
| 4,472,598 | 9/1984 | Boyd et al. | 174/102 SP X |
| 4,536,609 | 8/1985 | Neuroth | 174/102 SP X |
| 4,569,392 | 2/1986 | Peterman | 174/47 X |
| 4,644,094 | 2/1987 | Hoffman | 174/47 |
| 4,665,281 | 5/1987 | Kamis | 174/102 R |
| 4,716,260 | 12/1987 | Hoffman | 174/102 R |
| 4,726,314 | 2/1988 | Ayers | 174/47 X |
| 4,740,658 | 4/1988 | Hoffman | 174/103 |
| 4,830,113 | 5/1989 | Geyer | 166/369 |
| 4,938,060 | 7/1990 | Sizer | 73/151 |
| 4,979,794 | 12/1990 | Evans | 350/96.23 |

FOREIGN PATENT DOCUMENTS

| | | | |
|---|---|---|---|
| 213017 | 12/1954 | Australia | 174/102 SP |
| 15190 | 5/1972 | Japan | 174/102 R |

*Primary Examiner*—Morris H. Nimmo

*Attorney, Agent, or Firm*—Ross, Howison, Clapp & Korn

[57] ABSTRACT

An electrical cable assembly (10) comprising a cable core (12) and filler layer (16) encased in longitudinally welded reeled tubing (23) so as to restrict relative axial and longitudinal motion between the cable core (12) and reeled tubing (23). Small-diameter tubing (24) is optionally provided as part of the cable core (12) to facilitate the delivery of fluids such as lubricants and corrosion inhibitors to downhole equipment. A method is disclosed for deploying electrical cables in deep wells through use of the subject apparatus.

4 Claims, 5 Drawing Sheets

ELECTRICAL CABLE IN REELED TUBING

BACKGROUND OF THE INVENTION

1. Field of the Invention

This invention relates to electrical cable used to supply power to downhole equipment like submersible pumps in subterranean wells. More particularly, the invention relates to electrical cable encased in steel tubing that is known in the industry as reeled or coiled tubing. Optionally, the invention relates to reeled tubing that encases cable bundles comprising both electrical conductors and small-diameter tubing adapted to deliver lubricants, corrosion inhibitors or other fluids to downhole equipment.

2. Prior Art

It is well known that conventional electrical conductors comprising insulated copper wire lack sufficient tensile strength to support their own weight when used in the long vertical run lengths frequently needed for downhole applications. One method previously used to strengthen such conductors has been the incorporation of one or more steel cables inside the cable bundle.

Longitudinally wrapped and seamed cables comprising coaxial electrical conductors are disclosed in U.S. Pat. Nos. 3,394,400; 3,405,228; 3,530,019 and 4,083,484. Such cables are not, however, satisfactory for use in the vertical oilfield applications discussed above.

U.S. Pat. No. 3,615,977 discloses a method for insulating coaxial tubing systems using a material that is foamed in situ.

U.S. Pat. Re. No. 28,961 discloses a method and apparatus for manufacturing soft metal sheaths for electrical wires.

U.S. Pat. No. 4,938,060 discloses a method and apparatus wherein an electrical cable connected to a downhole sensor extends longitudinally up the interior of coil tubing to receiving and control equipment located at the surface adjacent the wellbore. The tubing conducts injection fluid to a desired location within the borehole and protects the electrical cable when running into or out of the hole. In this apparatus the coil tubing does not function to support the weight of the electrical cable.

SUMMARY OF THE INVENTION

According to the present invention, an electrical cable assembly is provided that comprises a cable core having a plurality of conventional, individually insulated electrical conductors encased in reeled tubing in such manner that relative longitudinal or rotational movement between the cable core and the reeled tubing is restricted. According to one preferred embodiment of the invention, small-diameter tubing is included with the electrical conductors in the cable core to permit minor amounts of lubricants, corrosion inhibitors or other fluids to be delivered downhole or circulated as desired.

According to another embodiment of the invention, longitudinally welded reeled tubing is provided that comprises a cable core and a heat curable filler belt disposed between the cable core and the tubing. The cable core desirably comprises a plurality of individually insulated electrical conductors. The filler belt is adapted to expand upon heating so as to fill substantially all the space between the cable core and the tubing, thereby limiting relative axial or rotational movement between them. A weld seam protection strip is preferably provided to protect the cable core and filler belt as flat steel stock is rolled and welded around the cable core to form the reeled tubing.

According to another embodiment of the invention, inert gas such as nitrogen or corrosion inhibiting fluids may be injected into the reeled tubing at the well surface to fill any voids or flow passages between the inside diameter of the reeled tubing and the electrical cable components installed therein.

According to another embodiment of the invention, texturing is provided or protrusions are formed on the inwardly facing surface of steel strip stock prior to rolling and welding the stock around the cable core and filler belt. The use of such texturing or protrusions further limits any relative axial or rotational movement between the cable core and the welded reeled tubing during use. Alternatively, the cable core and filler belt is wrapped with a perforated metal or fiber tape, and barbs or other similarly effective protrusions on the inside surface of the steel strip stock engage the perforations to assist in limiting relative axial or rotational movement.

According to another embodiment of the invention, the steel strip stock used to make reeled tubing is perforated at predetermined intervals to permit well fluid to enter the tubing and provide hydrostatic balancing of the cable inside the tubing when it is deployed inside a well.

According to another embodiment of the invention, an expandable, thermosetting filler material can be injected continuously or at intervals through perforations in reeled tubing in sufficient quantity to prevent axial or rotational movement between the insulated electrical conductors and the reeled tubing.

According to another embodiment of the invention, the cable core and filler material are wrapped with tape having axially spaced spiral windings.

According to another embodiment of the invention, the cable core comprises an outer polymeric sheath having longitudinally spaced cylindrical metal sleeves bonded thereto which are tacked to the reeled tubing along the weld line as the strip sheet stock is rolled and welded to encase the cable core and sleeves.

According to another embodiment of the invention, metal bands are bonded around a cable core at longitudinally spaced intervals, and the cable core is inserted into preformed reeled tubing. The location of the metal bands within the reeled tubing is thereafter determined by means such as ultrasonic scanning, and the reeled tubing is mechanically crimped down into the metal bands.

According to another embodiment of the invention, a method is provided for utilizing electrical cable in a subterranean well, the method comprising the steps of encasing the electrical cable in reeled steel tubing in such manner that relative axial and rotational motion between the cable and tubing is restricted, and thereafter deploying the encased electrical cable in the well.

By securing an electrical cable core inside reeled steel tubing, either by mechanical or chemical bonding, or a combination thereof, the weight of the copper wire or other electrically conductive material is transferred to and supported by the steel tubing. The undesirable effects of ratcheting or twisting are also avoided, and the cable core is protected from being pinched, abraded or severed while being run into the well.

BRIEF DESCRIPTION OF THE DRAWINGS

The invention is further described and explained in relation to the following figures of the drawings in which.

DESCRIPTION OF THE PREFERRED EMBODIMENTS

Reeled tubing units and pipe injectors such as shown in U.S. Pat. Nos. 4,938,060 and 4,655,291 are commonly used to service oil and gas wells. Reeled tubing units provide ease of access to the downhole well bore and reduced maintenance time for well servicing. By placing an electrical power cable within reeled tubing, these same advantages are available for the installation and removal of downhole submersible pumps.

Figure 8:
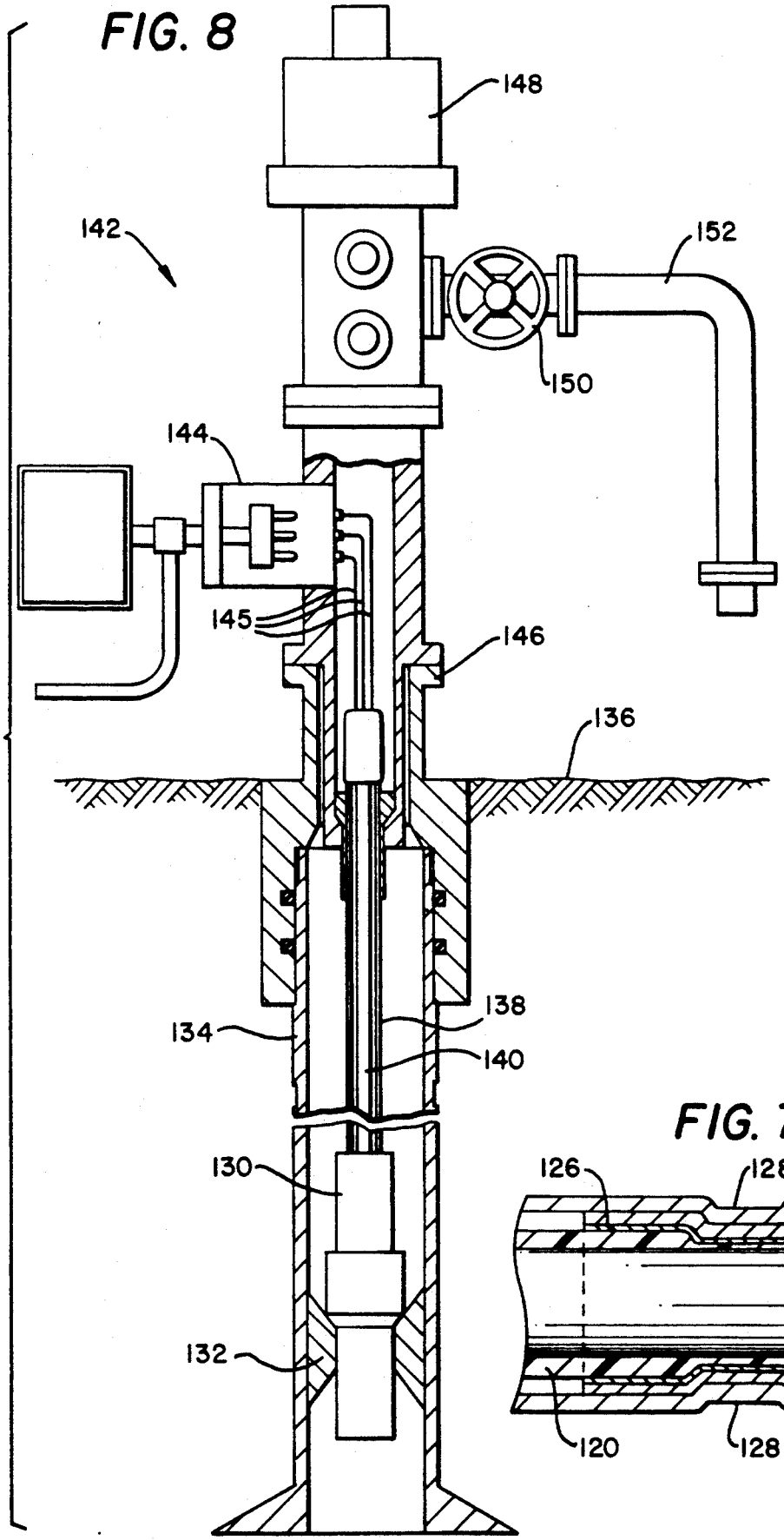
FIG. 8 is a schematic elevation view, partially in section, depicting an example of a well completion with an electric submersible pump deployed downhole by means of reeled tubing having the electrical cable disposed therein.

FIG. 8 is a schematic view showing a well completion with an electric submersible pump deployed downhole by means of reeled tubing having the electrical cable disposed therein. Referring to FIG. 8, electric submersible pump 130 is deployed downhole in landing nipple 132 inside casing 134 beneath surface 136. Electric submersible pump 130 is suspended from reeled tubing 138 having cable core 140 disposed therein in accordance with the present invention. Above surface 136, Christmas tree 142 is operatively connected to wellhead 146. Electrical conductors 145 from cable core 140 are operatively connected to a conventional electrical energy source by electrical cable breakout 144. Wing valve 150 controls the flow of hydrocarbons produced through casing 134 into flow line 152. Christmas tree 142 is topped by tree cap 148.

Figure 1:
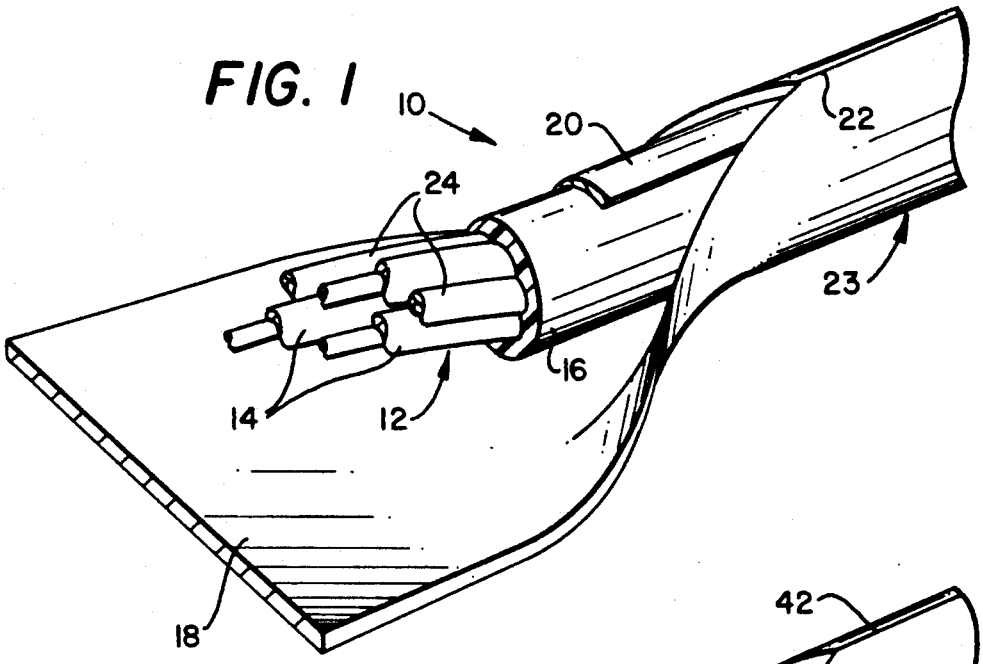
FIG. 1 is a perspective view depicting a partially broken-away section of cable core being encased in rolled steel strip sheet stock to form the encased electrical cable of the invention.

Referring to FIG. 1, encased cable assembly 10 of the invention preferably comprises cable core 12 and filler layer 16 disposed inside steel tubing that is rolled or formed from strip sheet stock 18 and welded along line 22. Strip 20 of thermally insulative material is preferably provided to avoid thermal degradation of cable core 12 or filler layer 16 during welding. A preferred thermally insulative material for use as strip 20 is a heat-resistant aromatic polyamide fiber such as that marketed by DuPont under the tradename "Nomex".

Cable core 12 preferably further comprises a plurality of individually insulated electrical conductors 14. According to a particularly preferred embodiment of the invention, small-diameter tubing 24 is also provided for use in delivering minor amounts of fluids such as lubricants and corrosion inhibitors to pumps and other downhole equipment. When bundled with cable core 12 and encased inside reeled tubing 23 in this manner, small-diameter tubing 24 is protected from being pinched or ruptured as it is being run into or out of the well.

Filler layer 16 is preferably a continuous layer formed around cable core 12 by extrusion or other similarly effective means, and preferably comprises a heat-curable thermosetting material that will expand to occupy any voids between cable core 12 and the inside surface of reeled tubing 23. Such thermosetting materials are well known and commercially available. A satisfactory method for heat-curing filler layer 16 is to place entire reels of reeled tubing 23 inside a curing oven after the tubing is welded around cable core 12 and uncured filler layer 16.

Another preferred material for use as elastomeric filler layer 16 of the invention is ethylene-propylene terpolymer (EPDM rubber), which swells upon contact with oil. The use of a cable bundle comprising such a filler layer in the encased cable assembly of the invention permits a relatively loose fit between filler layer 16 and reeled tubing 23 during initial installation, followed by expansion of filler layer 16 when exposed to oil to provide mechanical support between the cable bundle and the reeled tubing. It will be appreciated upon reading this disclosure that other similarly effective filler materials can also be used as filler layer 16 in the present invention. Such materials will preferably swell upon heating or upon contact with oil, and when restrained from further swelling, will develop predictable pressures that will not weaken reeled tubing 23.

Figure 9:
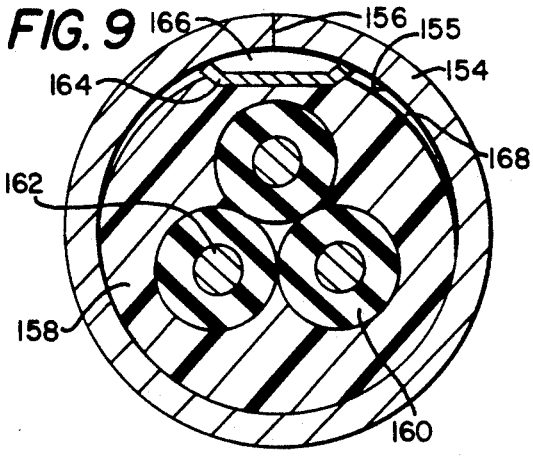
FIG. 9 is an enlarged cross-sectional detail view of an electrical cable encased in steel tubing, with a thermally insulative strip disposed between the cable core and steel tubing that is adapted to maintain separation between the cable core filler material and steel tubing during welding, to help limit movement of the cable core relative to the welded tubing, and to provide a flow channel to allow oil to be pumped into the tubing to expand the filler material.
Figure 10A:
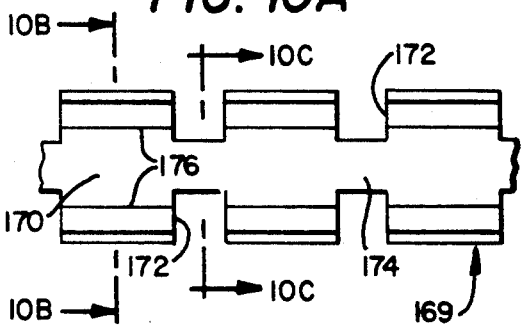
FIG. 10A is an enlarged, detail plan view of one preferred embodiment of a thermally insulative strip for use between the steel tubing and the cable core filler material.

FIG. 9 depicts an embodiment of the invention in which a cable bundle comprising a plurality of electrical conductors 162, each surrounded by insulation 160, is encased in filler material 158. This cable bundle is disposed inside reeled tubing 154. Beneath seam 156, strip 164 is disposed between filler layer 16 and reeled tubing 154. Strip 164 is adapted to keep filler layer 158 away from seam 156 during welding; to help resist movement of the cable bundle inside reeled tubing 154; and to provide a flow channel whereby oil can be pumped through longitudinally extending spaces 166, 168 between filler layer 158 and reeled tubing 154. Where filler layer 158 comprises a material such as EPDM rubber that will swell upon contact with oil, pumping oil through spaces 166, 168 can cause filler layer 158 to swell into tight-fitting contact with reeled tubing 154. If desired, strip 164 can be configured to define a flow channel 166 that can be used as a fluid flow path for injecting chemical inhibitors or lubricants for downhole equipment such as a pump and motor.

Figure 11A:
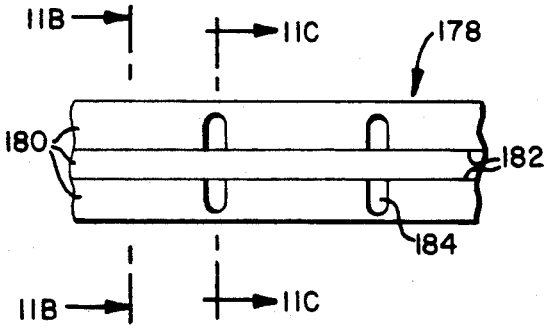
FIG. 11A is an enlarged, detail plan view of an alternate embodiment of a thermally insulative strip for use between the steel tubing and the cable core filler material.
Figure 10B:
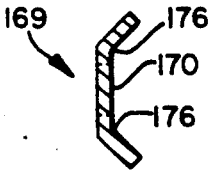
FIGS. 10B and 10C are cross-sectional views taken along lines 10B—10B and 10C—10C, respectively, of FIG. 10A.
Figure 10C:
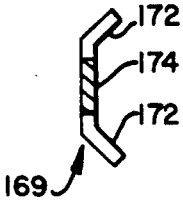
Figure 11B:
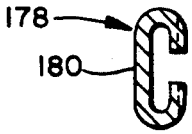
FIGS. 11B and 11C are cross-sectional views taken along lines 11B—11B and 11C—11C, respectively, of FIG. 11A.
Figure 11C:
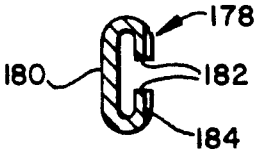

Referring to FIGS. 11A, 11B and 11C, a preferred strip 169 is shown that can be used in place of strip 164 in the encased cable assembly of FIG. 9 where it is desired to permit oil flowing through channel 166 to contact filler material 158. Strip 169 preferably comprises a plurality of full-width sections 170 that are separated longitudinally by reduced-width sections 174 having notches 172 disposed on each side thereof. Fold lines 176 cooperate to cause reduced-width sections 174 to be spaced radially away from interiorly facing wall 155 of reeled tubing 154. Notches 172 in reduced-width sections 174 permit some of the oil pumped through the space between the strip and the reeled tubing to flow circumferentially outward into contact with the filler layer.

FIGS. 11A, 11B and 11C depict another strip that can be used in place of strip 164 in FIG. 9. According to this embodiment, strip 178 comprises a longitudinally extending, C-shaped body 180 having oppositely disposed side edges 182. A plurality of longitudinally spaced recesses 184 are provided to facilitate fluid flow circumferentially outward between strip 178 and the reeled tubing.

Figure 12B:
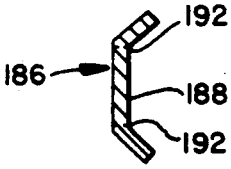
FIGS. 12B and 12C are cross-sectional views taken along lines 12B—12B and 12C—12C, respectively, of FIG. 12A.
Figure 12A:
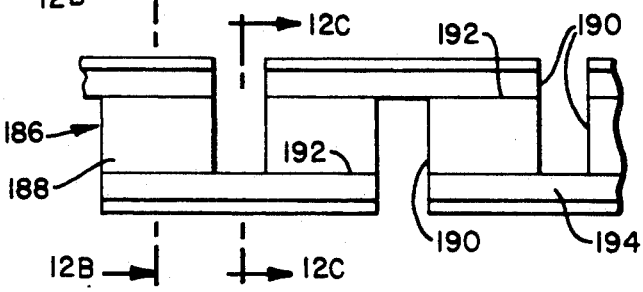
FIG. 12A is an enlarged, detail plan view of an alternate embodiment of a thermally insulative strip for use between the steel tubing and the cable core filler material.
Figure 12C:
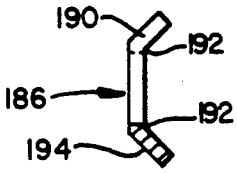

FIGS. 12A, 12B and 12C depict another strip that can be used in place of strip 164 in FIG. 9. According to this embodiment, strip 186 comprises a plurality of longitudinally spaced full-width sections 188 separated by notches 190 that alternate from side to side. Longitudinal web portions 194 provide structural integrity opposite notches 190. Fold lines 192 provide spacing between the middle part of strip 186 and the reeled tubing in which it is used. Notches 190 also facilitate the elongation of strip 186 as might be desirably if strip 186 is spirally wound around the filler layer.

Referring again to FIG. 1, the purpose of using an expandable elastomeric material between cable core 12 and reeled tubing 23 is to restrict relative axial and rotational movement of cable core 12 inside reeled tubing 23. In so doing, a significant portion of the weight of the electrical conductors 14 is transferred to and supported by the reeled tubing 23. This feature is particularly important in deep wells where the weight of the electrical conductor 14 can exceed its tensile strength.

Figure 2:
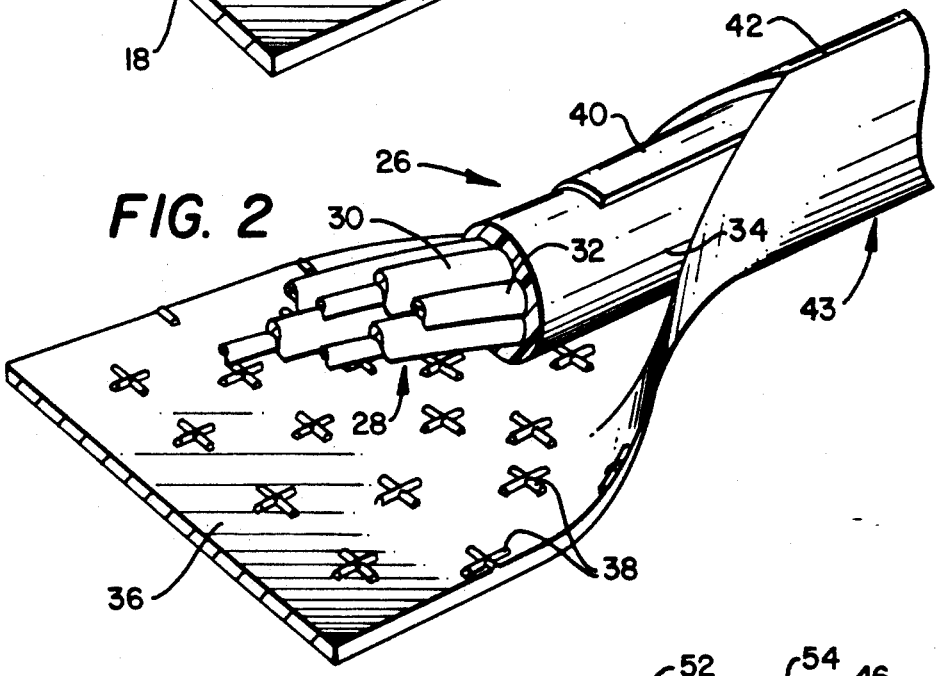
FIG. 2 is a perspective view depicting a partially broken-away section of cable core being encased in rolled steel strip sheet stock to form the encased electrical cable of the invention.

Another means for providing a mechanical bond between the cable core and tubing is disclosed and discussed in relation to FIG. 2. Referring to FIG. 2, encased cable 26 of the invention preferably comprises cable core 28 and filler belt or layer 34 disposed inside steel tubing 43 that is rolled or formed from strip sheet stock 36 and welded along line 42. Strip 40 is preferably provided to avoid thermal degradation of cable core 28 or filler layer 34 during welding as discussed above.

Cable core 28 preferably further comprises a plurality of individually insulated electrical conductors 30. According to a particularly preferred embodiment of the invention, small-diameter tubing 32 is also provided for use in delivering minor amounts of fluids such as lubricants to pumps and other downhole equipment. Surface texturing or protrusions 38 can be provided on the inwardly facing surface of steel strip stock 36 prior to rolling or forming reeled tubing 43 around cable core 38 and filler layer 34. Protrusions 38 will further assist in providing a mechanical bond between cable core 28 and reeled tubing 43 after filler layer 34 is expanded and cured.

Figure 3:
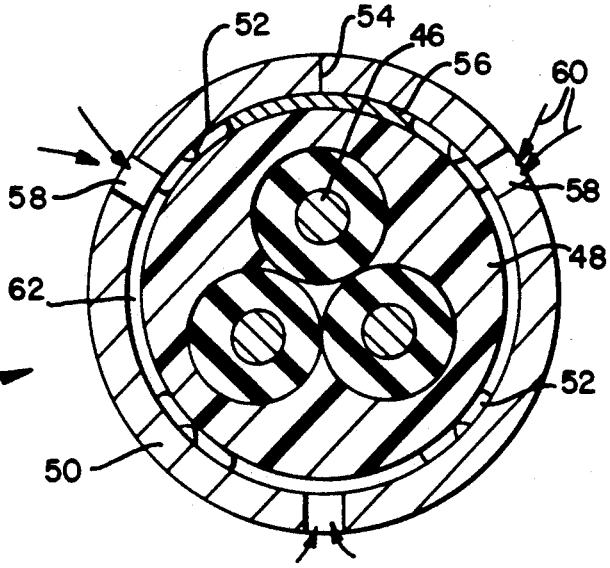
FIG. 3 is an enlarged cross-sectional detail view of an electrical cable encased in steel tubing in which the steel tubing contains perforations adapted to provide hydrostatic balancing of the cable within the tubing.

According to another preferred embodiment of the invention, as shown in FIG. 3, protrusions 52 on the inside surface of steel tubing 52 can also be used to maintain a desired spacing between a non-expandable filler material 48 and steel tubing 50 where it is desired to maintain a longitudinally extending fluid flow channel 62 through tubing 50 around the cable core. In FIG. 3, electrical conductors 46 are disposed inside filler material 48, which can be an extruded polymeric material that is thermally stable at the operating conditions to be encountered during use of the subject electrical cable assembly. With this embodiment of the invention, thermal expansion and curing of the filler material within the reeled tubing containing the electrical cable core is not required, as protrusions 52 are compressed against filler material 48 to provide a mechanical bond therebetween. In some instances, a similar configuration may be desirable to avoid the need for thermal curing even where it is not intended to provide a fluid flow channel inside the reeled tubing.

Alternatively, as discussed above, filler material 48 can comprise a polymeric sheath made of vulcanized rubber or some other similarly effective material that will swell when exposed to fluid hydrocarbons when the reeled tubing in which it is encased is deployed downhole.

Electrical cable assembly 44 of FIG. 3 further comprises a plurality of radially spaced orifices or perforations 58 that serve to permit fluid ingress or egress, or to promote hydrostatic balancing inside and outside of reeled tubing 50. Although not visible in FIG. 3, it is understood that such perforations can be provided at any desired longitudinal spacing as well.

Longitudinal flow channel 62 may be used to inject corrosion inhibiting fluids at desired downhole locations or to surround cable assembly 44 with an inert gas such as nitrogen. Perforations 58 may be omitted if cable assembly 44 performs better in a nitrogen gas environment.

Figure 4:
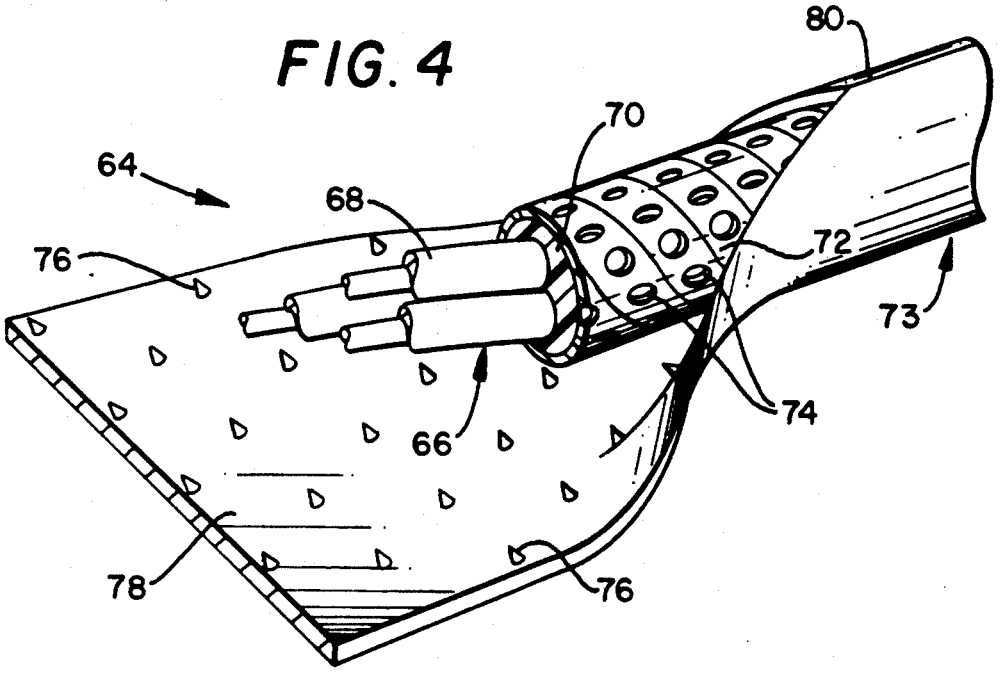
FIG. 4 is a perspective view depicting a partially broken-away section of cable core being encased in rolled steel strip sheet stock, with perforated metal tape spirally wrapped around the cable core so that the perforations are engaged by some of the protrusions on the inside surface of the sheet stock as it is formed and welded around the cable core.
Figure 4A:
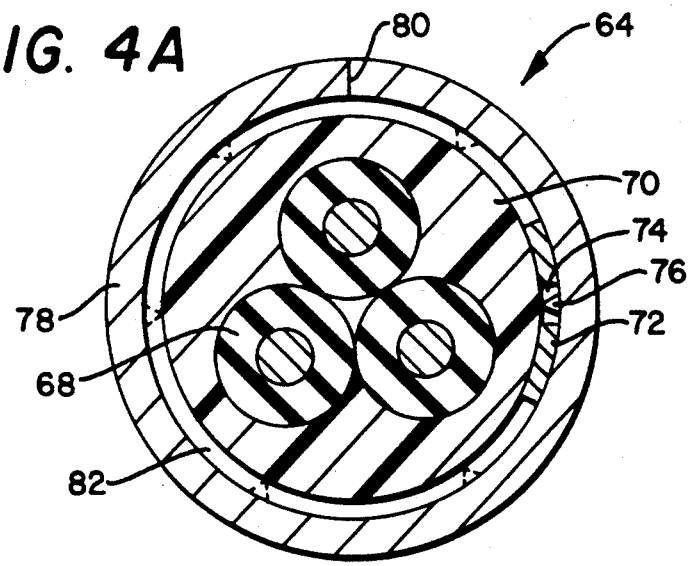
FIG. 4A is an enlarged cross-sectional detail view of an electrical cable encased in steel tubing as in FIG. 4 in which one of the inwardly extending protrusions on the inside surface of the reeled tubing has engaged a perforation in the metal tape.

Referring to FIGS. 4 and 4A, another embodiment of the invention is provided wherein tubing-encased electrical cable assembly 64 comprises a plurality of individually insulated electrical conductors 68 that are sheathed with a polymeric filler material 70 that is spirally wrapped with perforated tape 72. Steel strip stock 78 further comprises a plurality of axially and radially spaced barbs 76 that extend radially inward as strip stock 78 is rolled or formed around cable core 66, filler material 70 and perforated tape 72, then welded along longitudinal seam line 80 to form reeled tubing 73. Where tape 72 is made of metal, the need for a protective, axially extending strip beneath weld line 80 can be avoided. As barbs 76 engage perforations 74 in perforated tape 72, a mechanical interlock is established that restricts relative axial and rotational motion between cable core 66 and reeled tubing 73. Longitudinal flow channel 82 provides the same options for fluid injection as previously described for FIG. 3.

Figure 5:
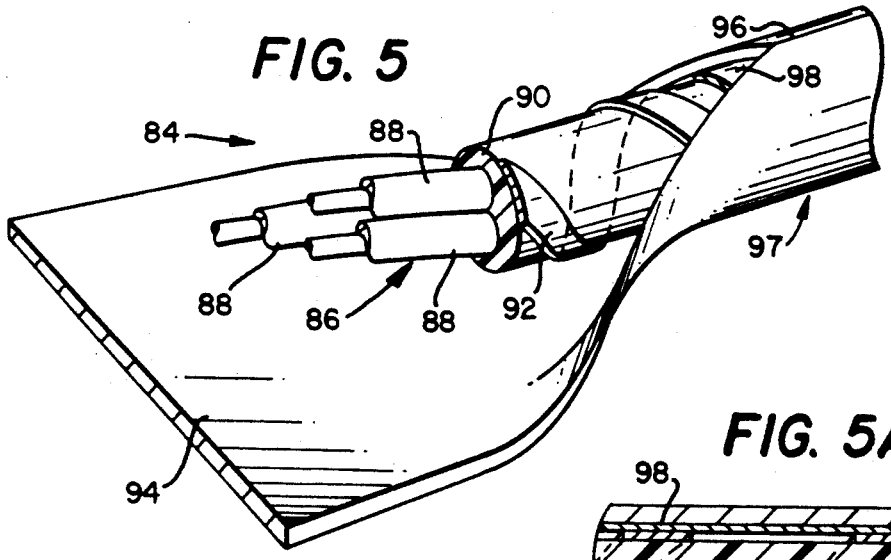
FIG. 5 is a perspective view depicting a partially broken-away section of cable core being encased in rolled steel strip sheet stock, and further comprising axially spaced spiral windings of metal tape adapted to provide a fluid flow channel between the cable core and the tubing wall.
Figure 5A:
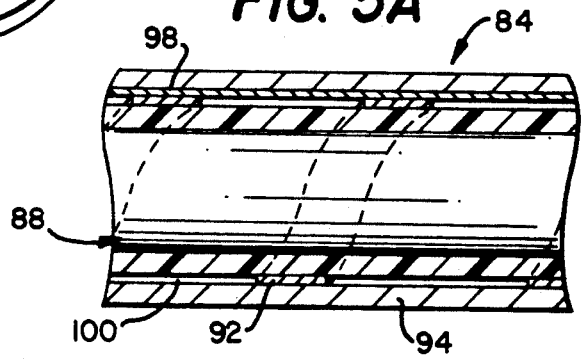
FIG. 5A is a longitudinal sectional elevation view of a portion of the encased electrical cable assembly of FIG. 5 in which the individual electrical conductors are not shown in order to simplify the drawing.

Referring to FIGS. 5 and 5A, another embodiment of the invention is provided wherein tubing-encased electrical cable assembly 84 comprises a plurality of individually insulated electrical conductors 88 that are sheathed with a polymeric filler material 90 that is spirally wrapped with metal tape 92. According to the embodiment shown in FIGS. 5 and 5A, the tape windings are axially spaced so as to provide a longitudinally extending fluid flow channel 100 through reeled tubing 97. As steel strip stock 94 is rolled or formed around cable core 86, filler material 90 and tape 92, and then welded along longitudinally extending seam 96 to form reeled tubing 97, protective strip 98 is desirably inserted beneath seam 96 to avoid unintended thermal degradation of the cable core.

Filler material 90 used in the embodiment shown in FIGS. 5 and 5A can be selected from materials adapted to swell around tape 92 and into a friction fit within the inside wall of reeled tubing 97 whenever a liquid hydrocarbon or other specified fluid is pumped through flow channel 100. Alternatively, filler material 90 can be selected from a material adapted to undergo thermal expansion and setting when subjected to elevated temperatures either prior to or during use.

Figure 6:
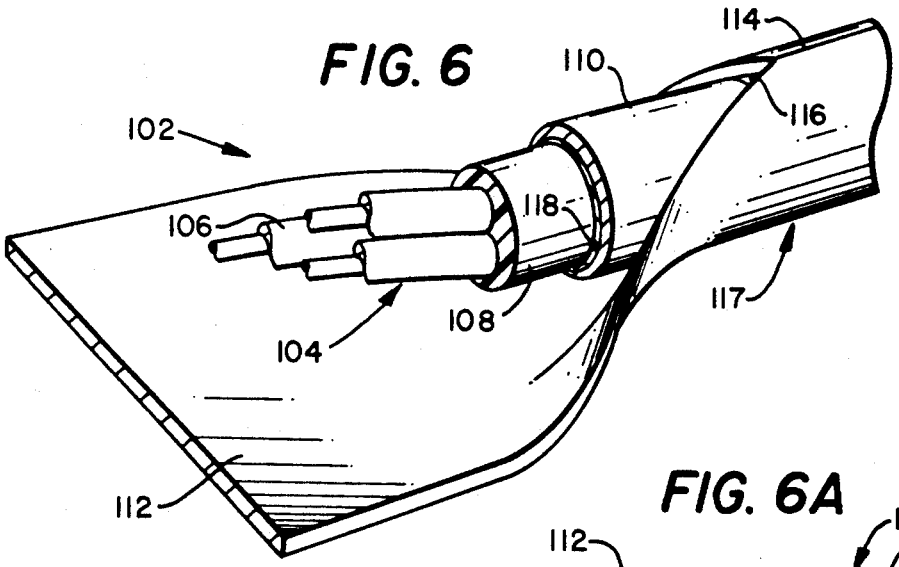
FIG. 6 is a perspective view depicting a partially broken-away section of cable core being encased in rolled steel strip sheet stock, with axially spaced cylindrical metal sleeves bonded to the outside of the cable core and tacked to the inside of the reeled tubing.
Figure 6A:
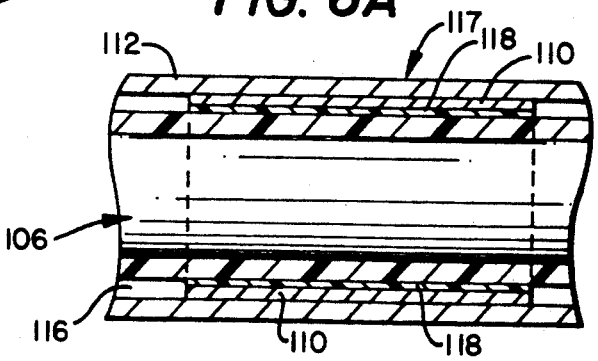
FIG. 6A is a longitudinal sectional elevation view of a portion of the encased electrical cable of FIG. 6 in which the individual electrical conductors are not shown in order to simplify the drawing.

Referring to FIGS. 6 and 6A, another embodiment of the invention is provided wherein tubing-encased electrical cable assembly 102 comprises a plurality of individually insulated electrical conductors 106 that are sheathed with a polymeric filler material 108. Axially spaced sleeves, represented in the sections shown in FIGS. 6 and 6A by sleeve 110 and preferably made of metal, are bonded to filler material 108 by layer 118 of any satisfactory, commercially available epoxy or bonding agent. Where sleeve 110 is made of metal, sleeve 110 is adapted to be welded to the inside surface of strip stock 112 during welding along seam 114 to make reeled tubing 117. The chemical bond between filler material 108 and sleeve 110 cooperates with the weld between sleeve 110 and tubing 117 to restrict relative axial and rotational movement between cable core 104 and reeled tubing 117.

Figure 7:
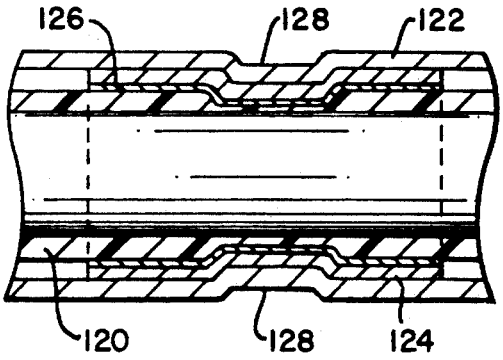
FIG. 7 is a longitudinal sectional elevation view of a portion of reeled tubing in which the reeled tubing has been mechanically crimped to a metal band bonded to an electrical cable disposed within the tubing.

Another embodiment of the invention in which a cable core is inserted into preformed reeled tubing is described in relation to FIG. 7. Referring to FIG. 7, cable core 120 (comprising a plurality of individually insulated electrical conductors, and optionally at least one fluid flow conductor, which are not shown in FIG. 7 for purposes of simplification) is inserted into preformed reeled tubing 122 by pulling, pumping or other similarly effective means. Prior to insertion of cable core 120 within reeled tubing 122, bands 124 (preferably metal) are bonded to cable core 120 at longitudinally spaced intervals using epoxy 126 or the like. After cable core 120 is inserted into reeled tubing 122, the position of metal band 124 is ascertained by ultrasonic scanning or other similarly effective means, and reeled tubing is secured to band 124 by externally applied crimp 128. Crimping reeled tubing 122 to cable core 120 in this manner limits axial and rotational movement of cable core 120 within the reeled tubing.

According to another embodiment of the invention, a method is provided for utilizing electrical cable in a subterranean well, the method comprising the steps of encasing the electrical cable in reeled steel tubing in such manner that relative axial and rotational motion between the cable and tubing is restricted, and thereafter deploying the encased electrical cable in the well. By securing an electrical cable core inside reeled steel tubing, either by mechanical or chemical bonding, or a combination thereof, the weight of the copper wire or other electrically conductive material is transferred to and supported by the steel tubing. The undesirable effects of ratcheting or twisting are also avoided, and the cable core is protected from being pinched, abraded or severed while being run into the well.

Although the apparatus and method of the invention are disclosed and described herein in relation to their preferred embodiments, it will be understood and appreciated by those of ordinary skill in the art upon reading this disclosure that other similarly effective means can also be used for providing mechanical or chemical bonding that will stabilize the cable core inside reeled tubing so as to restrict relative longitudinal or rotational motion of the cable core within the tubing. Thus, for example, the filler belt or sleeves surrounding the cable core can be bonded to either the cable core or the steel tubing, or to both, using commercially available bonding agents. Similarly, if desired, one can simply crimp the steel tubing downward against a filler material surrounding the electrical cable core at predetermined longitudinally and/or radially spaced intervals to provide a mechanical bond and thereby restrict relative axial and rotational motion between the cable core and the tubing wall.

Such alterations or modifications are believed to be within the scope of the invention, and the inventors intend that the scope of the invention be limited only by the broadest interpretation of the appended claims to which they are legally entitled.

We claim:

1. An electrical cable assembly for use in subterranean wells, said assembly comprising:

a cable core further comprising a plurality of electrical conductors;

longitudinally seamed, steel tubing disposed around said cable core; and means disposed between said cable core and said steel tubing for restricting relative axial and rotational movement between said cable core and said tubing, wherein said restricting means comprises a plurality of axially spaced metal cylinders, said metal cylinders surrounding said cable core and being bonded to said cable core and to said steel tubing.

2. The electrical cable assembly of claim 1 wherein said steel tubing is crimped over said metal cylinders and said cable core.

3. An electrical cable assembly for use in subterranean wells, said assembly comprising:

a cable core further comprising a plurality of electrical conductors;

longitudinally seamed, steel tubing disposed around said cable core, said steel tubing comprising an inside wall having protrusions extending radially inward therefrom; and means disposed between said cable core and said steel tubing for restricting relative axial and rotational movement between said cable core and said tubing, wherein said restricting means comprises tape that is spirally wrapped around said cable core and bonded to said cable core, said tape further comprising means for engaging said protrusions.

4. An electrical cable assembly for use in subterranean wells, said assembly comprising:

a cable core further comprising a plurality of electrical conductors;

longitudinally seamed, steel tubing disposed around said cable core; and means disposed between said cable core and said steel tubing for restricting relative axial and rotational movement between said cable core and said tubing, said restricting means comprising a longitudinally extending strip adapted to permit continuous fluid flow longitudinally through said steel tubing between said cable core and said tubing, wherein a filler material expandable upon contact with the fluid is disposed between the cable core and the strip, and wherein the strip comprises voids adapted to provide contact between the flowing fluid and filler material along said strip.

* * * * *